US007140927B2

(12) United States Patent
Casses et al.

(10) Patent No.: US 7,140,927 B2
(45) Date of Patent: Nov. 28, 2006

(54) ELECTRICAL CONTACT TERMINAL COMPRISING AN ELASTIC CONTACT BLADE

(75) Inventors: Claude Casses, Clevilliers (FR); Jean-Francois Clerc, Paris (FR)

(73) Assignee: FCI, Versailles (FR)

( * ) Notice: Subject to any disclaimer, the term of this patent is extended or adjusted under 35 U.S.C. 154(b) by 0 days.

(21) Appl. No.: 10/525,102

(22) PCT Filed: Aug. 26, 2003

(86) PCT No.: PCT/FR03/50041

§ 371 (c)(1),
(2), (4) Date: Nov. 14, 2005

(87) PCT Pub. No.: WO2004/021519

PCT Pub. Date: Mar. 11, 2004

(65) Prior Publication Data

US 2006/0121797 A1 Jun. 8, 2006

(30) Foreign Application Priority Data

Aug. 27, 2002 (FR) ..... 02 10640

(51) Int. Cl.
*H01R 11/22* (2006.01)

(52) U.S. Cl. ..... 439/852

(58) Field of Classification Search ..... 439/842, 439/843, 851, 852, 847, 856
See application file for complete search history.

(56) References Cited

U.S. PATENT DOCUMENTS

| | | | | |
|---|---|---|---|---|
| 3,713,080 | A * | 1/1973 | Kennedy | 439/852 |
| 5,645,458 | A * | 7/1997 | Hotea | 439/852 |
| 5,941,740 | A * | 8/1999 | Neuer et al. | 439/852 |
| 5,941,741 | A * | 8/1999 | Dobbelaere et al. | 439/852 |
| 6,468,116 | B1 * | 10/2002 | Koide | 439/867 |
| 6,520,811 | B1 * | 2/2003 | Mitani et al. | 439/852 |

* cited by examiner

*Primary Examiner*—Tho D. Ta
(74) *Attorney, Agent, or Firm*—Harrington & Smith, LLP

(57) ABSTRACT

The invention relates to an electrical contact terminal which is obtained by cutting and folding a small electrically-conductive metal plate (13), consisting of a rear part (5) which can be used to connect an electric wire (1) and a front part (3) comprising a first folded blade which forms a contact blade (11, 11') with a complementary contact blade, said contact blade (11, 11') comprising at least one formed part (12, 12') which is disposed in a fold area of the aforementioned contact blade.

7 Claims, 3 Drawing Sheets

ELECTRICAL CONTACT TERMINAL COMPRISING AN ELASTIC CONTACT BLADE

FIELD OF THE INVENTION

The invention concerns an electrical contact terminal comprising an elastic contact blade whose flexibility assures a better electrical contact with a complementary contact terminal. In particular, the invention concerns a female electrical contact terminal with an elastic contact blade, made in a single piece from a cut and folded strip, and designed to receive a complementary male contact terminal.

The invention is applied in the field of electrical or electronic connector technology and, in particular, in the connector technology field dedicated to the automobile industry.

STATE OF THE ART

In the connector technology field, less expensive connectors are increasingly sought. For this purpose, one seeks to design connectors requiring the least possible amount of material, on the one hand, and, on the other hand, the simplest manufacture possible. In order to conform to these requirements, it is known to create female or male connectors, or contact terminals in a single piece from a single plate of sheet metal or electrically conductive metal, called a strip, cut and folded to form the desired connector.

In particular, female electrical contact terminals of the cage type are created. Such a contact terminal has a rear part in which an electric wire is attached by crimping, to be connected with another electric wire attached in a complementary male contact terminal. This female contact terminal also has a front part in the shape of a cage, designed to receive the male contact terminal. The female contact terminal can also comprise a transition part connecting the front part with the rear part.

Such a female contact terminal is described in patent application EP-A-0 959,531. The cage of this contact terminal is made from a plate of metal, or a strip, in which two sides (or lateral walls) and a top part are created. The top part is made of two pieces placed side by side. A tab is cut and folded in each side designed to form a contact blade by which electrical contact is established between the female terminal and the complementary male terminal.

Very often, the tab designed to form this contact blade is cut into the extension of the side of the cage and folded towards the inside of the cage. This is notably the case in patent application EP-A-0 959,531.

In other female contact terminals, the contact blade can also originate from a tab cut into the rear part of the cage and folded towards the front of said cage.

Generally, each side of the cage also comprises an opening through which the contact blade is positioned. Regardless of the manner of creating the contact blade (folding towards the front or towards the rear of the cage), the opening, generally square in shape, is designed to receive a pin for locking the terminal into a cavity of a connector box receiving this terminal.

Thus, when the complementary male contact terminal is introduced into the female contact terminal, the contact tail of the male terminal is pinched between two contact blades of the female contact terminal.

Now, the known contact blades of contact terminals are simply folded towards the inside of the cage. Thus, when the contact tail of the male contact terminal is introduced between the two contact blades, it is important that the two contact blades remain in permanent contact with the contact tail. It is therefore necessary that the contact blades are supple or flexible.

For this purpose, a fine strip can be chosen, which offers a great flexibility to contact blades. However, with a fine strip, there are great risks of tearing or shearing the contact blades at the level of the folding zone. In fact, in a general manner, the female contact terminal becomes fragile in constricted places and in particular at the level of cutting line intersections. In fact, due to the cutting, shaping and folding of the strip, when the strip is thin, cutting line intersections can shear and/or tear under the action of lateral mechanical stress exerted on a wall or parallel to this wall. The risk of cutting and shearing contact blades is increased still further if, for any reason whatever, the male and female contact terminals must be disassembled before being reassembled.

In contrast, if a thick strip is chosen, then the contact blades are not very flexible. Now, if the contact blades are not flexible, then, under the stress of the contact tail being introduced between the contact blades, these blades are pushed apart from one another and electrical contact with the contact tail is poorly established.

Thus it is understood that it is difficult to find a compromise for the thickness of the strip so that the female terminal assembly is sufficiently rigid so as not to become fragile in the cutting line intersection zones and so that the contact blades are sufficiently flexible to remain in permanent contact with the contact tail of the male contact terminal.

DISCLOSURE OF THE INVENTION

The object of the invention is to remedy the disadvantages of the electrical contact terminals described previously. For this purpose, the invention proposes an electrical contact terminal in which the elastic contact blades are rendered more flexible by means of one or more formed parts created in the folding zone of said contact blades. In particular, the invention concerns female contact terminals, created from a single piece in a strip, in which the contact blades are folded toward the inside of said contact terminal. In this case, the contact terminal of the invention can also comprise reinforcing blades coming to be supported against the contact blades to reinforce these blades in the zone in contact with the contact tail of the complementary male terminal.

More precisely, the invention concerns a female electrical contact terminal obtained by cutting and folding a single plate of electrically conductive metal comprising:

- a rear part permitting a connection with an electric wire, and
- a front part comprising, on the one hand, a cage provided with a bottom, a top part and two sides and, on the other hand, at least one first blade, forming the contact blade with a complementary contact terminal, created in the extension of one of the sides and folded towards the inside of the cage, characterized in that each side has a second blade forming the reinforcing blade, folded towards a free end of the contact blade and supported on the free end of this contact blade.

Advantageously, the contact blade comprises at least one formed part created in a folding zone of said contact blade.

DETAILED DESCRIPTION OF THE EMBODIMENT OF THE INVENTION

Figure 1:
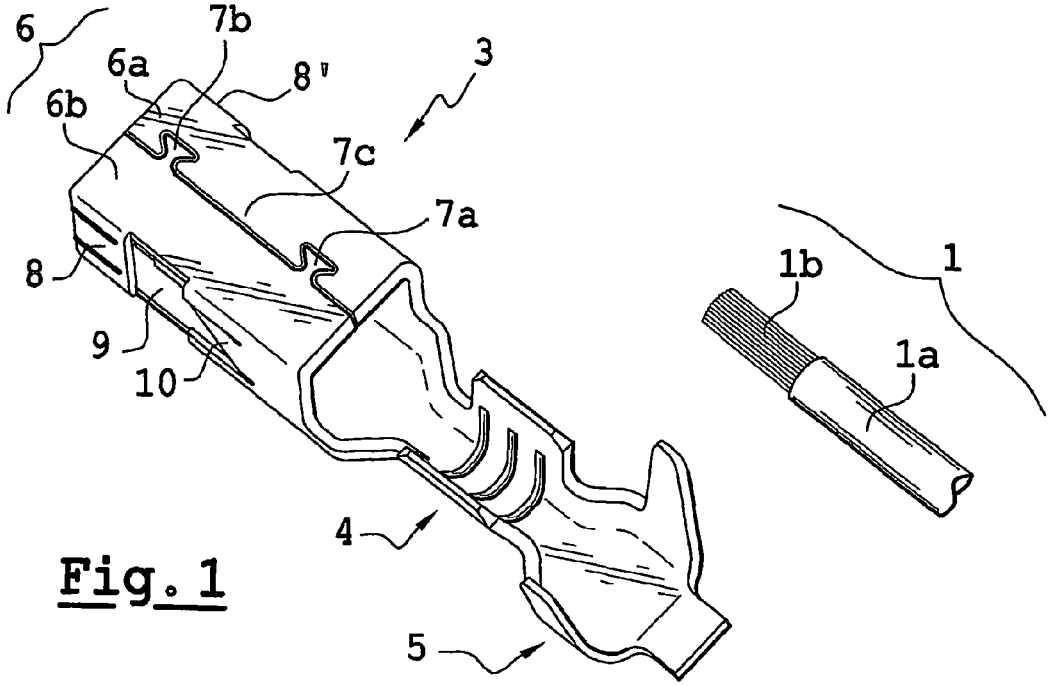
FIG. 1 shows a general view of a female electrical contact terminal according to the invention, before the electric wire has been crimped.

FIG. 1 shows a top view of a female electrical contact terminal conforming to one embodiment of the invention. This contact terminal 2 is shown when it is ready to be crimped around an electric conduction wire 1. In other words, in this FIG. 1, female contact terminal 2 is shown when its front part 3 is cut and folded, while its rear part 5 and its transition part 4 are cut and awaiting the introduction and crimping of electric wire 1.

Rear part 5 of female contact terminal 2 comprises a bottom and two sides, of complementary shapes, forming crimping wings. These sides are shown open in FIG. 1, that is, in the position in which they are found after folding of the strip forming the contact terminal but before crimping of the electric wire. These sides are designed to be folded and crimped around insulation la of electric wire 1 to hold it in fixed position in the contact terminal.

Transition part 4 of female contact terminal 2 also comprises a bottom and two sides, of complementary shapes. As in the case of the rear part, the sides of the transition part are shown open in FIG. 1, that is, in the position in which they are found after folding of the strip forming the contact terminal but before crimping of the electric wire. These sides are designed to be folded and crimped around the stripped zone 1*b* of electric wire 1 so that an electrical contact is established between the stripped part of electric wire 1 and transition part 4 of the contact terminal. Thus, when electric wire 1 has been introduced into the rear and transition parts 5 and 4 of the female contact terminal 2, these rear and transition parts are crimped around electric wire 1, which permits electrically connecting this wire 1 with another electric wire crimped in a male contact terminal complementary to the female contact terminal of the invention.

The female contact terminal of the invention has dimensions and an outer form identical to those of female contact terminals of the prior art. It can thus be inserted into a classical male contact terminal, currently used in the connector technology field. The male contact terminal complementary to the female contact terminal of the invention thus will not be described here.

Front part 3 of contact terminal 2 forms a cage having a bottom 16 and a top part 6 formed of two parts 6*a* and 6*b* joined to one another to form an appreciably flat surface. In one example of embodiment, the two parts 6*a* and 6*b* are interlocked with one another, thus making top part 6 of the cage rigid. For example, as shown in FIG. 1, part 6*a* of the top part comprises projecting parts forming tenons 7*a* and 7*b* and the other part of the top part has notches forming mortises 7*c*, receiving the tenons of part 6*a*. Parts 6*a* and 6*b* can also be simply placed side by side without being interlocked with one another.

The cage comprises two lateral sides or walls 8 and 8', of which only side 8 is visible in FIG. 1. Each side comprises a tab, on the front part of the cage, this tab being folded towards the inside of the cage to form a contact blade. The contact blades of this female contact terminal are not visible in this figure. They will be described in detail in the following with reference to FIGS. 2 to 4.

Wall 8 of the cage comprises an opening 9 as well as a second tab designed to form a reinforcing blade 10. This side 8 as well as side 8', identical to side 8, will be described in more detail in the following.

Figure 2:
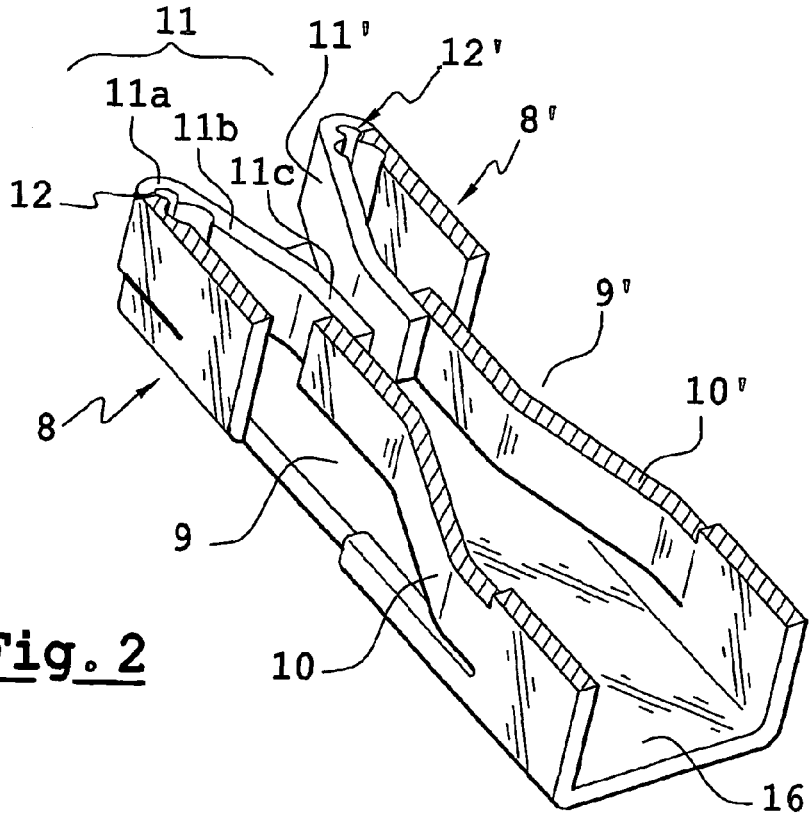
FIG. 2 shows a detailed view of the inside of the cage of the female electrical contact terminal of FIG. 1.

In FIG. 2, the inside of the contact terminal cage of FIG. 1 is shown in profile according to a view from the rear of the contact terminal.

For a better comprehension of the invention, FIG. 2 shows the contact terminal cage of FIG. 1, in which top part 6 has been removed. The fact that there is no top part on this cage does not constitute an embodiment of the invention; this is simply intended to permit a better understanding of the invention by the reader.

One can thus see contact blades 11 and 11' created by the tabs cut out in the extension of sides 8 and 8' of cage 2 in this FIG. 2. These tabs 11 and 11' are symmetrical to one another. Thus, only contact blade 11 will now be described. This contact blade 11 is cut out in the extension of side 8 and folded towards the inside of the cage at an angle of approximately 135°, classical for contact blades. As is classically the case, this contact blade is then folded at its free end to be roughly parallel to side 8.

The two contact blades 11 and 11' together form a throat part designed to facilitate the insertion of a contact tail of the male contact terminal inside the cage of the female contact terminal.

Contact blade 11 is separated from blade 11' by a space, or clearance, the dimension of which is adjusted to receive the contact tail of the complementary male contact terminal.

According to the invention, the tab forming contact blade 11 comprises formed parts 12, situated in the zone where the tab is folded towards the inside of the cage. These formed parts 12 are created by punching the strip, after it is cut, but before it is folded and, in particular, before folding of the tab forming contact blade 11. Contact blade 11' comprises formed parts 12' symmetrical to those of blade 11.

These formed parts give the contact blades a certain flexibility, thus rendering the contact blades more elastic. Moreover, these formed parts have the advantage of enlarging the part of the tab that is folded, which elongates the contact blade towards the inside and increases the contact zone with the contact tail of the male terminal, without requiring a greater quantity of strip. These formed parts also have the advantage of reducing stress on the contact blades in their folding zone.

According to one embodiment of the invention, a single formed part can be created in each contact blade. According to another embodiment, several formed parts are created in each contact blade. The number of formed parts created depends essentially on the thickness of the strip as well as the desired flexibility for the contact blades.

This FIG. 2 also shows two tabs forming reinforcing blades 10 and 10'. These reinforcing blades 10 and 10' are cut out in sides 8 and 8' of the female contact terminal cage. Once cut out, these second tabs 10 and 10' are folded first towards the inside of the cage at an angle of the order of 45°, then folded again so as to render them roughly parallel to sides 8 and 8'. The free end of each of these tabs forming reinforcing blades 10 and 10' is then found supported against the inner face of one of contact blades 11 and 11', respectively. Each contact blade 11 and 11' is then reinforced by support on its free end by a reinforcing blade 10 and 10', which permits assuring that contact blades 11 and 11' are held in position.

In this manner, contact blades 11 and 11' are sufficiently flexible to facilitate the introduction of the contact tail but they do not risk being pushed apart from one another after introduction of the contact tail. In other words, the flexibility given to contact blades 11 and 11' by the formed parts assures an easy introduction of the contact tail between said blades and reinforcing blades 10 and 10' assure that they are held in position against this contact tail. The contact blades can thus remain in permanent contact with the contact tail of the male contact terminal.

According to one embodiment of the invention, reinforcing blades 10 and 10' are made with parts of the strip that are usually cut out in sides 8 and 8' to create openings 9 and 9'. The reinforcing blades are thus created with a part of the strip that is generally considered as waste. Thus a reinforcement of the contact blades is created without requiring an additional quantity of strip. In order to simplify the creation of these reinforcing blades, they can be of the width of openings 9 and 9'. These openings 9 and 9' can, in this case, be rectangular in shape.

Figure 3:
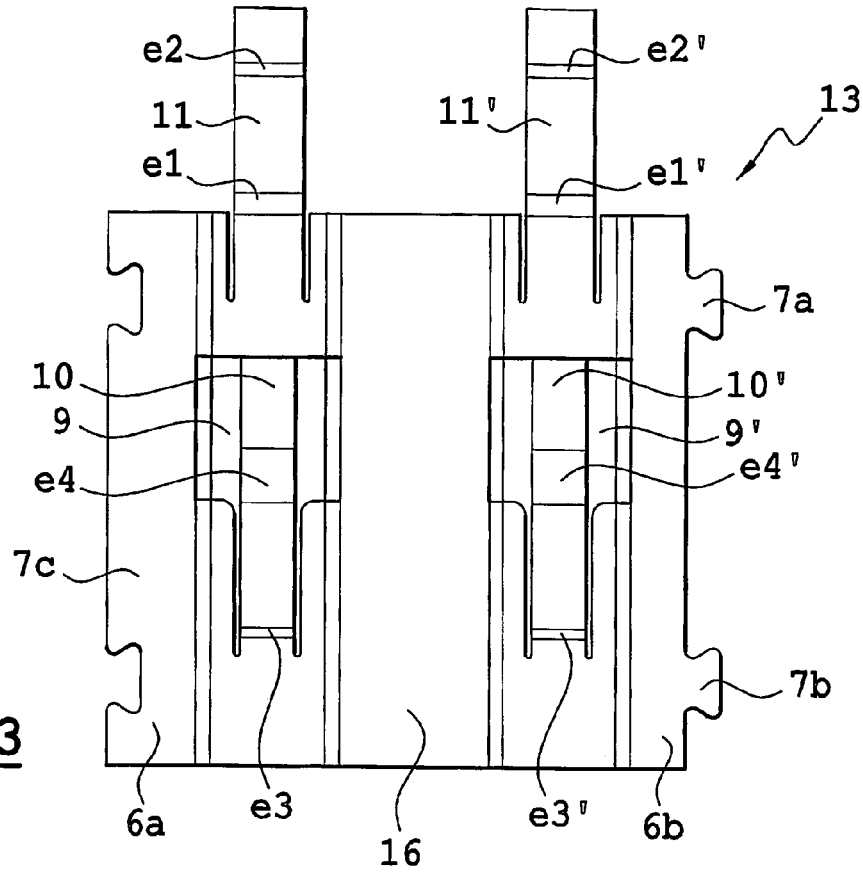
FIG. 3 shows a cut strip designed to be folded to form the contact terminal cage of FIG. 2.

A cut strip 13 is shown in FIG. 3, designed to be shaped to create a female contact terminal according to the invention. The cut-out parts of the strip are shown by thick lines and the folding zones of the strip, i.e., the places where the strip will be folded after it is shaped, are shown by thin lines. Therefore, cut-out parts 7*a*–7*c* designed to form the tenon/mortise assembly of top part 6, cut-out parts 10 and 10' of the tabs designed to form the reinforcing blades, cut-out parts 9 and 9' for the openings and tabs 11 and 11' designed to form the contact blades can be seen in this FIG. 3. As can also be seen in this FIG. 3, contact blades 11 and 11' are made from tabs cut out on the outside of the part of the strip designed to form the cage of the contact terminal.

Thus, zones e1 and e1' for the first folds of tabs 11 and 11' designed to form the contact blades, as well as zones e2 and e2' of the second folds of these tabs 11 and 11' are also shown in this FIG. 3. In addition, zones e3 and e3' for the first folds of tabs 10 and 10' designed to form the reinforcing blades and zones e4 and e4' for the second folds of these tabs 10 and 10' are also shown.

According to the invention, tabs 11 and 11' are formed, with one or more formed parts, in folding zones e1 and e1'. These tabs are then folded a first time at the level of zones e2 and e2', then a second time at the level of zones e1 and e1', i.e., the formed zones.

In one variant of the invention, the reinforcing blades can also comprise one or more formed parts created at the level of folding zones e3 and e3', before folding of the strip.

Figure 4:
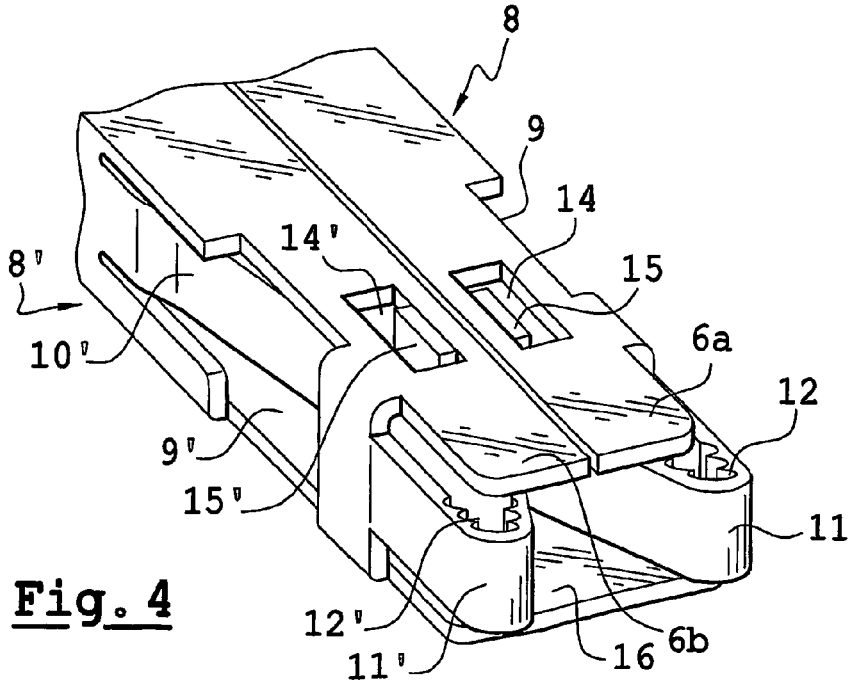
FIG. 4 shows the cut strip of FIG. 3 when it is folded to form the contact terminal cage.

The strip of FIG. 3 is shown after folding in FIG. 4, in a profile, according to a view from the front of the contact terminal. Thus contact blades 11 and 11' can be seen folded towards the inside of the cage of the female contact terminal in this FIG. 4. In the fold of these contact blades, a series of formed parts 12 and 12' can be seen. As shown in this figure, the formed parts can have the form of channels created in the width of the tab forming the contact blade. These formed parts can also have other forms that can depend on the desired flexibility for the contact blade.

Through opening 9', this FIG. 4 also shows reinforcing blade 10' created from side 8' of the cage and folded towards the inside of the cage so as to come to be supported against contact blade 11'.

According to one embodiment of the invention, reinforcing blade 10' can comprise one or two lateral tab pieces 15' cut out in the strip at the same time as the tab forming the reinforcing blade. In FIG. 4, only one tab piece has been shown for each reinforcing blade. These lateral tab pieces 15' and 15 are designed to end up in slots 14' and 14 created in top part 6 of the cage. In the case where each reinforcing blade comprises two tab pieces, one of these tab pieces ends up in a slot created in the top part of the cage, and the other one comes to rest in a slot created in bottom 16 of the cage. These slots of sizes adapted to the tab pieces have the role of receiving the tab pieces and, thus, holding the reinforcing blades against the contact blades with a predefined play, depending on the width of the slot. This play corresponds to the play allowed for the contact blades, i.e., the movement permitted the contact blades during introduction of the contact tail of the male terminal. In other words, these tab piece and slot assemblies permit limiting the spring movement of the contact blades in opening and protect them against a pull that surpasses their elastic capacity during introduction of a contact tail. Thus they define a clearance between the contact blades.

According to one embodiment of the invention, bottom 16 and top part 6 each have an overhanging front part, situated facing the U-shaped section comprising the folding zone of the contact blade.

Figure 5:
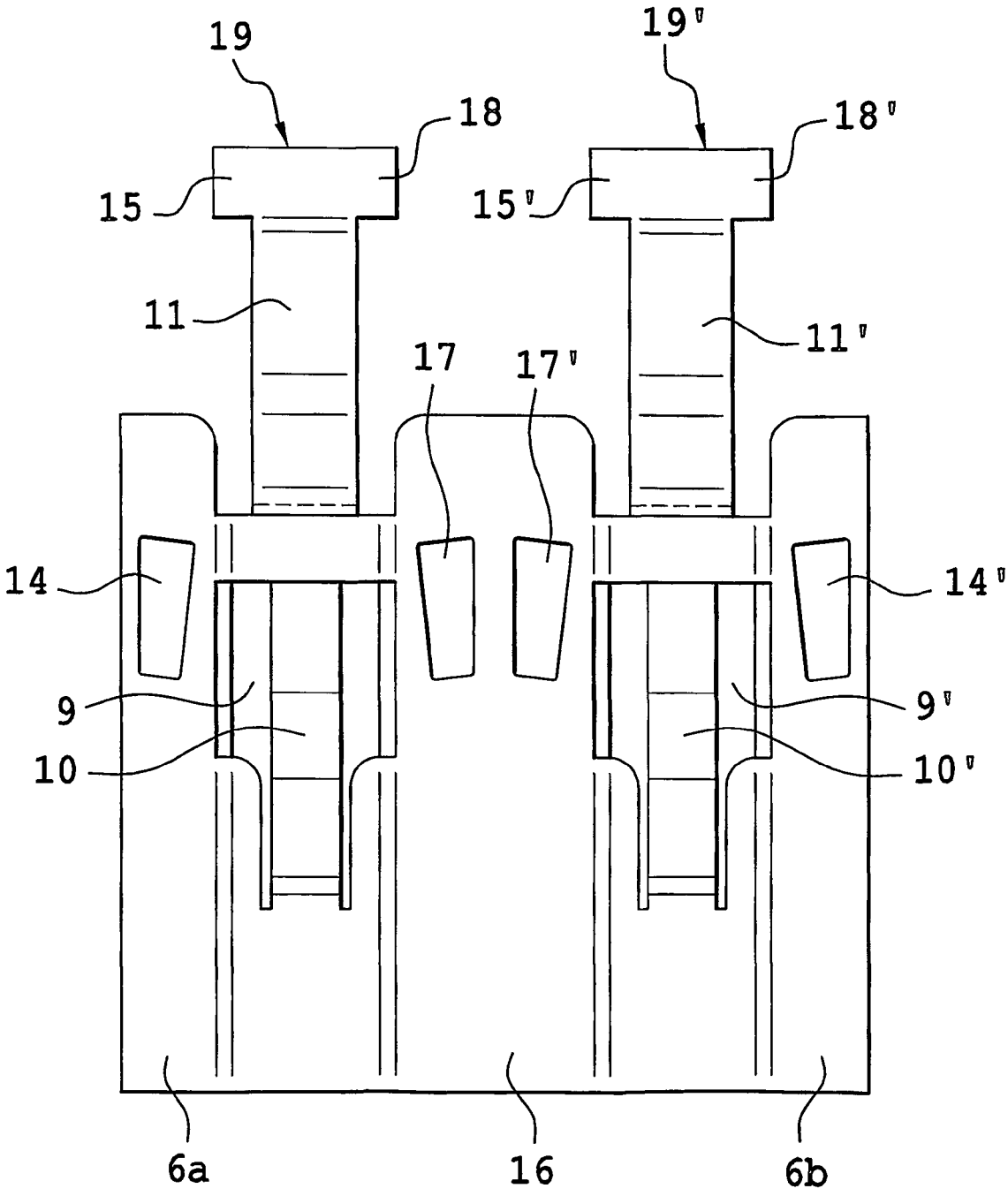
FIG. 5 shows another example of a cut strip, ready to be folded.

In another embodiment, it is contact blades 11 and 11' that each have one or two lateral tab pieces. This embodiment is shown in FIG. 5, in the form of a cut-out strip, ready to be folded. The strip example of FIG. 5 comprises a part designed to form top part 6 of the cage. In this example, the two parts 6*a* and 6*b* of the top part are folded and positioned side by side to form the top part.

In this embodiment, tab pieces 15, 18 and 15', 18' are cut from either side of free end 19, 19' of contact blades 11 and 11'. Tab pieces 15 and 18 can thus end up in slots 14 and 17 created, respectively, in top part 6 and in bottom 16 of the cage. Likewise, tab pieces 15' and 18' can end up in slots 14' and 17' created, respectively, in top part 6 and in bottom 16 of the cage. The contact blades can also each comprise only a single tab piece; in this case, the tab pieces end up in slots 14 and 14' of top part 6, or in slots 17 and 17' of bottom 16.

As in the previous embodiment, these tab pieces and these slots permit limiting the clearance of the contact blades in opening and protect them against a pull that surpasses their elastic capacity, during introduction of a complementary contact terminal. Thus they define a precise clearance between the contact blades. It will be noted that this embodiment in which the tab pieces are created on the contact blades is easier to implement than the preceding embodiment since there is more material available around the contact blades than around the reinforcing blades. Moreover, this embodiment permits obtaining a better precision of the clearance, i.e., the distance between the inner faces of the contact blades.

In the embodiments that have just been described, the contact blades are created by tabs cut into the extension of the front part of the cage. However, the invention can also be implemented in female contact terminals whose contact blades are made from tabs cut into the rear extension of the cage. The formed parts are then created at the rear of the cage. In this case, the reinforcing blades that are created by the tabs cut into the extension of the front part of the cage are supported on the outer face of the contact blades. It is thus the reinforcing blades that form the throat part. These reinforcing blades have the advantage, in this case, of also comprising one or more formed parts, rendering the throat part more flexible.

In a general manner, the formed parts can be created in all contact terminals comprising a folded elastic contact blade, whether or not they are male or female terminals of the cage type.

The invention claimed is:

1. An electrical contact terminal obtained by cutting and folding a plate of electrically conductive metal comprising a rear part permitting connection with an electric wire and a front part comprising, on the one hand, a cage provided with a bottom, a top part and two sides and, on the other hand, at least one first blade, forming contact blade with a complementary contact terminal, created in the extension of one of the sides and folded towards the inside of the cage, characterized in that each side comprises a second blade forming a reinforcing blade, folded towards a free end of the contact blade and supported on the free end of this contact blade, and wherein the contact blade comprises at least one formed part created in a folding zone of said contact blade.

2. The contact terminal according to claim 1, further characterized in that the formed part is made on the contact blade before folding of the metal plate.

3. The contact terminal according to claim 1, further characterized in that the formed parts are made in the folded zone of the contact blade towards the inside of the cage.

4. An electrical contact terminal obtained by cutting and folding a plate of electrically conductive metal comprising:

a rear part permitting connection with an electric wire and a front part comprising, on the one hand, a cage provided with a bottom, a top part and two sides and, on the other hand, at least one first blade, forming contact blade with a complementary contact terminal, created in the extension of one of the sides and folded towards the inside of the cage, characterized in that each side comprises a second blade forming a reinforcing blade, folded towards a free end of the contact blade and supported on the free end of this contact blade, wherein the contact terminal comprises at least one lateral tab piece created on at least one of the blades and received in at least one slot created in the top part and/or the bottom of the cage.

5. The contact terminal according to claim 4, further characterized in that lateral tab piece is made on one contact blade.

6. The contact terminal according to claim 4, further characterized in that lateral tab piece is made on one reinforcing blade.

7. An electrical contact terminal obtained by cutting and folding a plate of electrically conductive metal comprising:

a rear part permitting connection with an electric wire and a front part comprising, on the one hand, a cage provided with a bottom, a top part and two sides and, on the other hand, at least one first blade, forming contact blade with a complementary contact terminal, created in the extension of one of the sides and folded towards the inside of the cage, characterized in that each side comprises a second blade forming a reinforcing blade, folded towards a free end of the contact blade and supported on the free end of this contact blade, wherein the bottom and the top part comprise an overhanging front part, facing a U-shaped section comprising a folding zone of the contact blade.

* * * * *